United States Patent [19]

Schnegg

[11] 4,395,889

[45] Aug. 2, 1983

[54] WOVEN-LIKE WARP KNIT FABRIC WITH TENSION CONTROL FOR TOP EFFECT YARN

[75] Inventor: Julius R. Schnegg, Burlington, N.C.

[73] Assignee: Burlington Industries, Inc., Greensboro, N.C.

[21] Appl. No.: 97,972

[22] Filed: Nov. 28, 1979

[51] Int. Cl.[3] ..... D04B 23/08

[52] U.S. Cl. ..... 66/193; 66/190; 66/202

[58] Field of Search ..... 66/190–195, 66/202

[56] References Cited

U.S. PATENT DOCUMENTS

| | | | |
|---|---|---|---|
| 3,036,448 | 5/1962 | Cundiff | 66/195 X |
| 3,084,529 | 4/1963 | Scheibe | 66/193 |
| 4,197,725 | 4/1980 | Kohl | 66/213 |

FOREIGN PATENT DOCUMENTS

| | | | |
|---|---|---|---|
| 430022 | 8/1967 | Switzerland | 66/193 |
| 871815 | 7/1961 | United Kingdom | 66/210 |
| 1165109 | 9/1969 | United Kingdom | 66/213 |

OTHER PUBLICATIONS

Paling, "Warp Knitting Technology", 1952, London, p. 152.

*Primary Examiner*—Ronald Feldbaum
*Attorney, Agent, or Firm*—Cushman, Darby & Cushman

[57] ABSTRACT

An improved warp knit fabric that can serve as a base fabric for producing full weight, self-lined drapery material as well as sheer drapery material and the process and apparatus therefor. The base fabric is primarily comprised of three groups of yarns knit together to form a sheer fabric that creates the visual effect of being woven. The full weight is formed by incorporating one or more additional groups of yarns into the base fabric. One group is added to produce a self-lining on the rear side of the material while another group can include a "laid-in" top effect yarn. This top effect yarn can be fed with varying tension control so that a relatively wide variety of effects can be created.

23 Claims, 12 Drawing Figures

WOVEN-LIKE WARP KNIT FABRIC WITH TENSION CONTROL FOR TOP EFFECT YARN

BACKGROUND OF THE INVENTION

Warp knitting, as known for many years, constitutes a type of knitting in which the yarns generally run lengthwise in the fabric. Yarns are prepared, as warps, on beams with one or more yarns being fed to each needle. Exemplary fabrics made by this type of knitting are tricot, milanese and raschel fabrics. Milanese knit fabrics constitute a type of run-resistant warp knit fabrics that exhibit a diagonal rib effect using several sets of yarns to make the fabric. Raschel knit fabrics can be made in plain or jacquard patterns with the latter being made to exhibit intricate eyelet and lacy patterns. Raschel fabrics are generally coarser than other types of warp knit fabrics and raschel type knitting machines have one or two sets of needles and up to 42 sets of guides. Tricot fabrics are another type of run-resistant warp knit fabric in which either single or multiple sets of yarns have been used to produce the fabric.

It has also been known in the past to lay-in surface effect yarns but the present invention concerns a particular method of laying-in surface effect yarns in order to produce particularly highly styled novelty fabrics which are well designed for use as drapery fabrics.

SUMMARY OF THE PRESENT INVENTION

The present invention comprises a method, the apparatus for accomplishing the method and several resulting novelty effect fabrics formed using standard knitting techniques. The fabrics appear to incorporate specialized novelty yarns but in fact do not. The resulting fabrics constitute warp knit, raschel type fabric that produce an outward visual appearance of being a woven fabric. Further, specialized tensioning equipment, used on a creel which supplies the top effect novelty yarn, controls the feeding of that effect yarn in a way that allows tension to be increased or decreased in a random or predetermined manner so that the effect yarn assumes the appearance of being a slub yarn or creates the appearance of having irregular and changing amounts of yarn secured to the fabric. In particular, the present invention has found a way to take a standard roving yarn and form that yarn into a ratine like effect yarn. In fact, the effect yarn is not only made to appear as a slub yarn but is also provided with a wavey or wiggle type of outward appearance.

The present invention also concerns the production of a combination of novel fabrics each of which begin with and include a base fabric. This base fabric is a sheer type material able to be used as sheer drapery material and which serves as a substrate for the other fabrics. By applying backing yarns to the sheer fabric a fuller and heavier weight fabric is produced that has a self-lining extending across the entire rear face of the fabric. This base fabric together with the self-lining applied to the rear face also serves as the fabric on which top effect yarns can be secured thereby producing an attractive and very full and dense fabric that can be used advantageously as drapery material.

The sheer fabric itself includes a plurality of groups of yarns which are designed so that the resulting fabric has the outward appearance of being woven. This appearance is carried over into the full weight fabrics comprised of the base fabric plus either or both of the backing and top effect yarns. Also, because the base fabric is used in each of the other fabrics there is little down time for the machine when changing fabric styles or types.

Prior to this present invention it was not possible to create special effects in a warp knit fabric that exhibited or occurred in an irregular frequency across the width of the fabric. Under normal warp knitting operations such irregular patterning, especially of top effect yarns, was not possible. Accordingly, the present invention has extended the range of novelty effects achievable with warp knit fabrics and incorporates means for creating irregular tensions in a controlled or random manner. In addition, this tension control can be applied to each top effect yarn or only to certain selected ones thereof in order to produce a wide variety of surface effects. Thus, it is possible with the present invention to produce a unique novelty yarn effect on warp knit goods without the use of any type of special novelty yarns, and to produce an improved warp knit fabric that exhibits the appearance of being woven. Further, the present invention increases the amount of yarn bulk that may be knit into a fabric which is especially desirable with drapery fabrics since heavy weight and dense fabrics are desirable.

Other objects, features and characteristics of the present invention as well as the methods and operation and function of the related apparatus will become more apparent upon consideration of the following detailed description and the appended claims with reference to the accompanying drawings, all of which form a part of this specification, wherein like reference numerals designate corresponding parts in the various figures.

BRIEF DESCRIPTION OF THE DRAWINGS

In the drawings:

FIG. 7 is a photograph of the sheer base fabric produced according to the present invention which includes the yarns shown in FIGS. 4 and 5 together with chain stitches;

DETAILED DESCRIPTION OF THE PREFERRED EMBODIMENT OF THE PRESENT INVENTION

Figure 1:
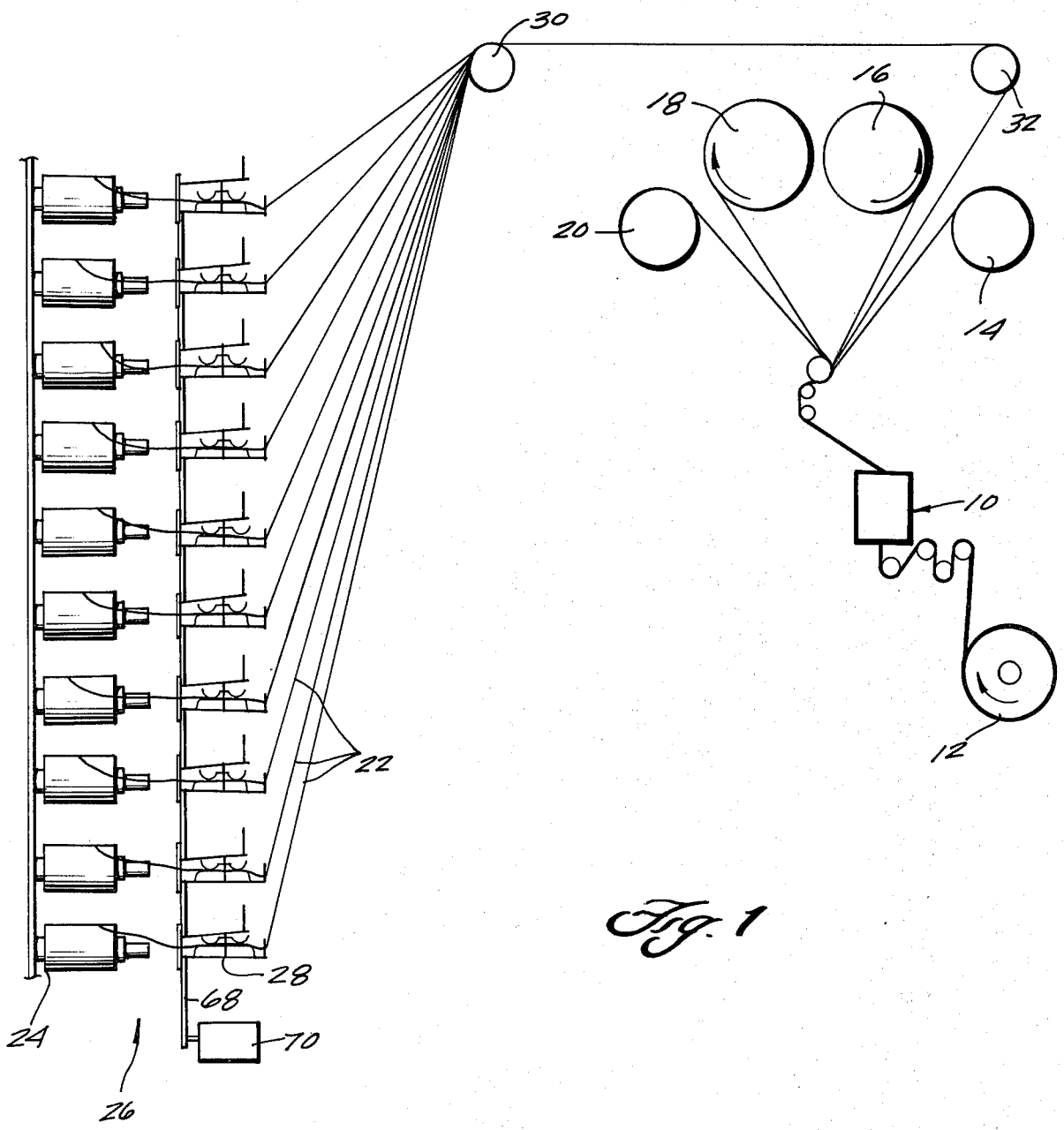
FIG. 1 is a diagrammatic side elevational view of the warp knitting machine arrangement used in the present invention together with a diagrammatic showing of a portion of the creel used to support packages containing the top effect yarn.

Turning now to FIG. 1 a side elevational view of the apparatus diagrammatically shows the warp knitting machine, generally indicated at 10, and the resulting warp knit fabric being taken up on a beam indicated at 12. Warp yarns are fed to the knitting machine 10 from beams indicated at 14, 16 18 and 20, respectively, which are supported on the warp knitting machine in a conventional manner.

As will be more fully explained hereafter the base, ground or sheer fabric produced in accordance with the present invention will be comprised of three groups of yarns, specifically, one group of yarns forming a plurality of chain stitches, a second group of ground or base yarns that tie the chain stitches together and a third group of weave effect yarns which together with the ground yarns create the visual appearance of a woven fabric. For example, the chain stitches can be supplied from beams 14 while the ground and weave effect yarns, respectively, can be supplied from beams 16 and 18.

In producing a full heavy weight drapery fabric, a backing fabric is usually applied to drapery fabrics. However, in the present invention the sheer material is provided with a self-lining by introducing a fourth group of yarns, referred to as backing yarns and the backing yarns can be supplied, for example, from beams 20.

The full weight fabric can also include top effect yarns indicated in FIG. 1 at 22, which are supplied from packages 24 held on a creel diagrammatically indicated at 26. Top effect yarns 22 will be pulled off of packages 24 and passed through tensioning devices, generally indicated at 28, from which they will pass around guie rollers 30 and 32 and then to the knitting machine bar controlling this placement in the knit fabric.

It should be pointed out that the warp knitting machine generally indicated at 10 can be a Mayer machine made by the Karl Mayer Textil-Maschinen Fabrik-GMBG D-6053 Obertshausen, West Germany or the Mayer Textile Machine Corp., 7102 Sherwin Road, Greensboro, N.C. 27410, type RM6-G-EV. Likewise creel 26 can be a Mayer draw-off creel which is a conventional piece of equipment. It is submitted that further description of the creel arrangement and the warp knitting machine are not required for one skilled in the art to fully understand the present invention and accordingly no further description will be provided herein.

As with many warp knitting machines, this Mayer machine employs as a standard item a 36 gauge linkage mechanism to control activation of the guide bars. In order to produce a variety of varying gauge fabrics the linkage mechanism is modified as necessary but this provides great flexibility. Thus, to produce a 9 gauge fabric, usually represented by lapping formulas which vary by two's (e.g. 0-2-4-6, etc), a factor of four (4) is needed to allow the 36 gauge linkage mechanism to produce 9 gauge movements. Thus, a lapping number sequence as written for use with this 36 gauge linkage mechanism also requires a modification by a factor of four. Thus:

0 becomes 0
2 becomes 8
4 becomes 16
6 becomes 24
8 becomes 32
10 becomes 40

The lapping formulas which follow are written for the 36 gauge linkage mechanism but if desired, can be converted into conventional 9 gauge figures by dividing the respective numbers by the appropriate factor, in this case by four (4).

Figure 2:
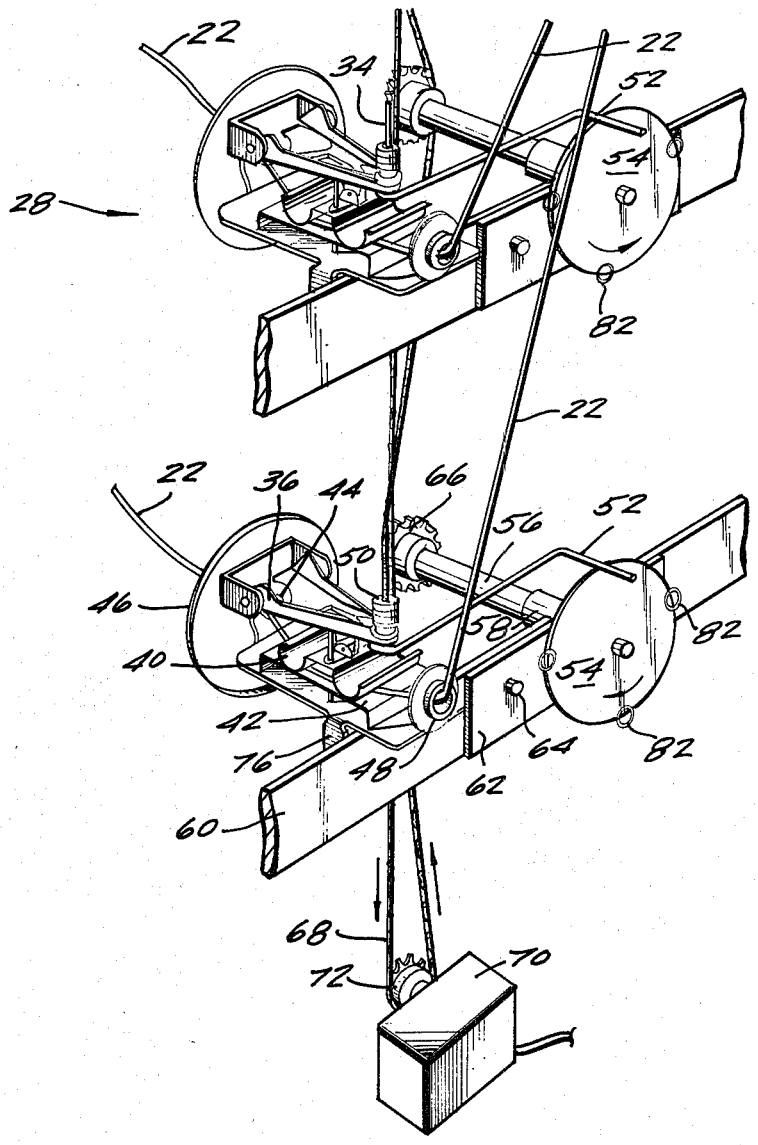
FIG. 2 is a detailed perspective of a portion of the top effect yarn tensioning device as mounted on the creel.
Figure 3:
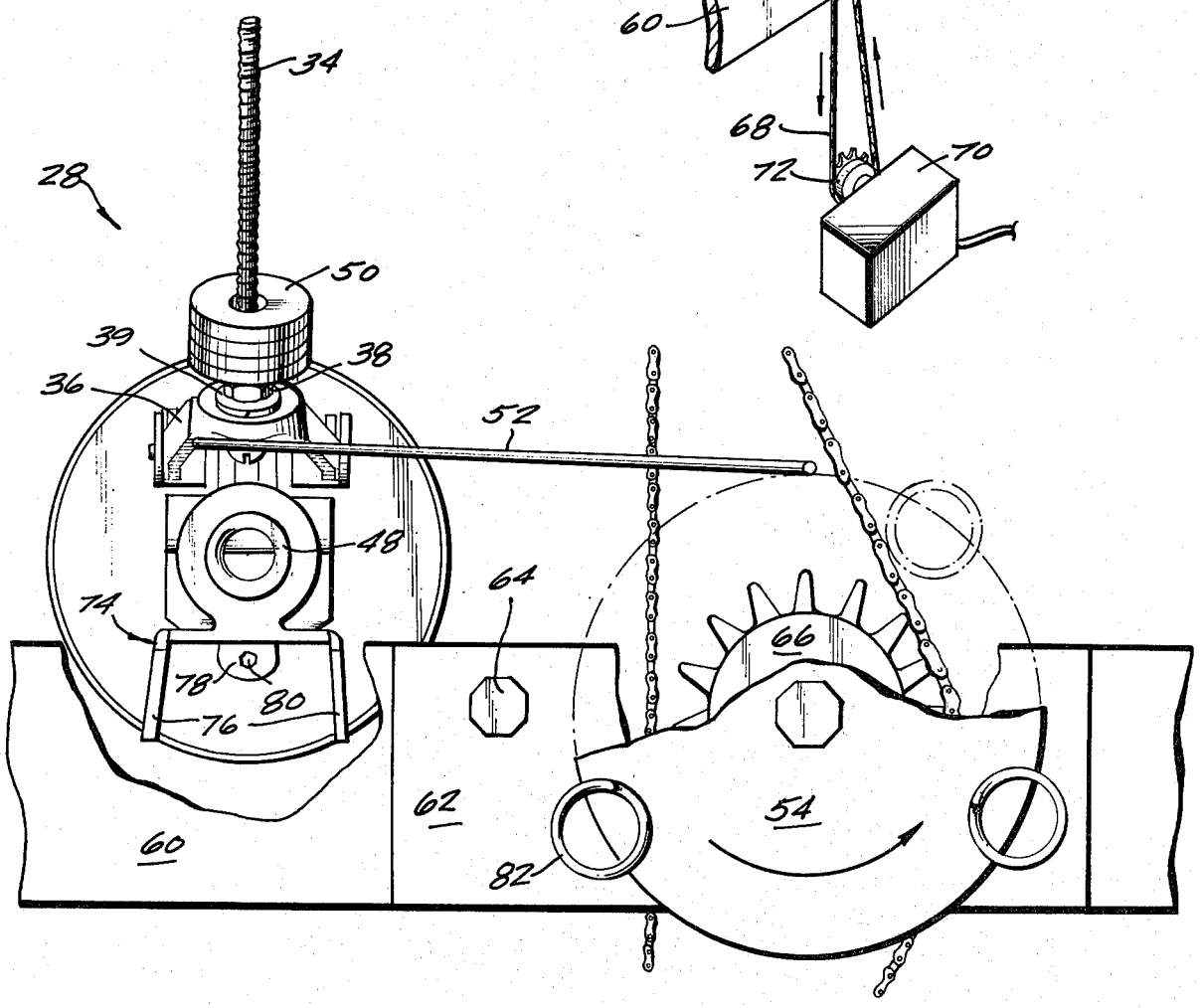
FIG. 3 is an enlarged front elevational view of one of the tensioning assemblies shown in FIG. 2 with portions cut away for clarity.

The tensioning devices 28 are shown in greater detail in FIGS. 2 and 3 and attention is now directed to those figures. The major portion of this tensioning device is a type BFS Mayer Leaf Spring Threadbrake. This threadbrake tensioning device, however, has been modified by incorporating bolt 34 in the pivotally mounted spring support arm 36 and is held in place by a nut 38 and lock washer 39. As shown in FIG. 2, a double leaf spring 40 is secured to the bottom side of support arm 36 and when support arm 36 is in its down or rest position the double leaf spring 40 engages the upper surface of a spring plate 42. Yarn 22, as shown in FIG. 2, will enter through a rear guide hole 44 provided in guide plate 46 and will pass through the device between double leaf spring 40 and spring plate 42 and will exit from a front guide 48. From guide 48 yarn 22 will pass upwardly as shown in FIG. 1 toward guide rollers 30 and 32. Bolt 34 is extra long so that a large number of weight disks 50 can be slid down bolt 34 and together apply tension or pressure on the yarn 22 by applying force on double leaf spring 40 as it rests against spring plate 42. How many disks 50 are used will vary with the yarn being used and the effects desired but should not be so great that stitches in the fabric will be broken.

The application of tension to top effect yarn 22 is controlled by means of lever arm 52 and cam 54. Cam 54 is mounted on a shaft 56 by any convenient means and shaft 56 is rotatably supported within a mounting collar 58 which is itself secured to one of the horizontal creel frame structural elements 60 by means of a mounting plate 62 and bolts 64. A drive gear 66 is secured to the other end of shaft 56 and is drivingly engaged by drive chain 68 which in turn is driven by drive motor 70 and a main drive gear 72. As shown in FIG. 1, ten tension devices 28 are usually located in each vertical row along the creel frame and one motor 70 will be provided for each vertical row. Also, the number of vertical rows can vary depending upon the number of top effect yarns being used.

As shown in FIG. 2, drive chain 68 alternates back and forth about drive gears 66 so that alternating cams 54 are driven in opposite directions as indicated by the arrows on the two cams 54 shown in FIG. 2. It should also be pointed out that tension device 28 is itself mounted on creel frame element 60 by a mounting bracket, generally indicated at 74, comprised of a pair of rear mounting legs 76 which extend over the backside of element 60 and a front mounting arm 78 which fits over the front of element 60. A set screw 80 is included in arm 78 and will when tightened bring legs 76 into engagement with element 60 thus securing tensioning device 28 thereto.

Lever arm 52 is connected to the pivotal support arm 36 by bolt 34 and the raising and lowering of lever arm 52 will likewise raise and lower the pivotal supporting arm 36 and leaf spring 40. Cam 54 can be shaped to include camming surfaces but I have found it is preferable to employ split rings 82 spaced at predetermined locations about the periphery of cam 54 in order to provide the camming action for lever arm 52 once the proper location for these has been selected.

It should also be pointed out that movement of lever arm 52 could be controlled by solenoids under the control of a randomizer circuit as described in U.S. Pat. Nos. 3,748,648 and 3,868,496.

The number of weight disks 50 that are needed will vary on the size and texture of the yarn being fed. However, the amount of weight should be enough to allow the yarn to be fed and yet produce the affects desired. In that regard, attention is directed to FIG. 8 where a fabric produced according to the present invention is shown. It is possible to see variations in the effects obtained in the top effect yarn. For example, there is one group of three yarns where the tension applied appears to be relatively uniform indicating that tension has been substantially constant and that cam 54 has not raised and lowered lever arm 52 to vary tension. Another group of darker yarns appear to have thick and thin areas so that the overall appearance is that the yarns exhibit slubbed and nonslubbed areas. The area where the yarn has the appearance of being slubbed will have been produced when lever arm 52 has been raised by one of the split rings 82 or by a cam surface if cam 54 were provided with cam surfaces. During the non-slubbed areas in the remaining length of the yarn (i.e., between slubbed areas) lever arm 52 will have been in its lowered position and tension has been applied by disks 50. It should also be noticed that the guide bar on the warp knit machine has been moved in the cross-machine direction or has been shogged back and forth across one wale. A typical shogging program is 0-0/0-0/8-8/8-8//. While this top effect yarn has been introduced onto the technical back of the knit fabric, that surface becomes the outer or front face or surface of the fabric in its finished form.

While a wide variety of yarn types could be used as this top effect yarn one particular type I have found to produce desirable effects is a yarn formed with a ten singles yarn as a core and a roving yarn parallel plied or wrapped therearound and later twisted with six singles to bind the yarn together, and to provide strength. by using such a yarn and by having it moved back and forth across a single wale, and also by employing the tensioning device discussed herebefore, it is possible to take a relatively straight or uniform yarn and produce a ratine like effect on the fabric. The above yarn can be identified also as a 386 yards/lb roving yarn and by varying the placement of the camming surfaces on cam 54 it is possible to produce specialized novelty effects across the surface of the fabric in an irregular frequency without using a special novelty yarn. Further, this method and apparatus provides a way of producing warp knit fabric containing irregular patterning of individual yarn ends that has not been otherwise possible.

Figure 5:
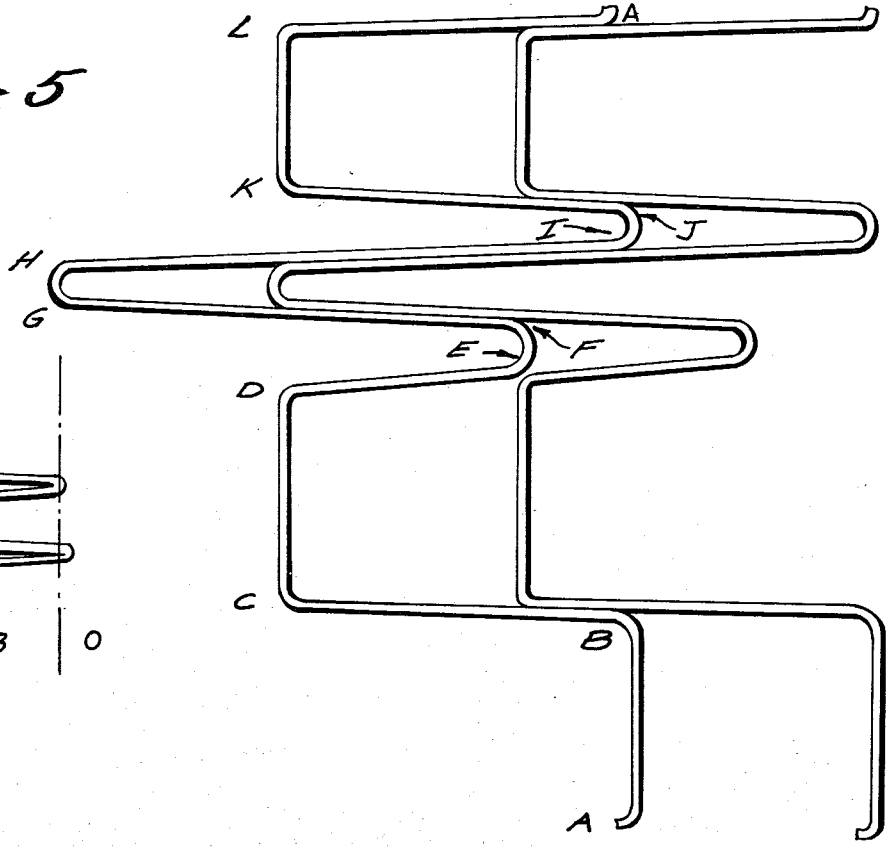
FIG. 5 is a diagrammatic showing of two repeats of the weave effect yarn used to produce the fabric made according to the present invention.
Figure 4:
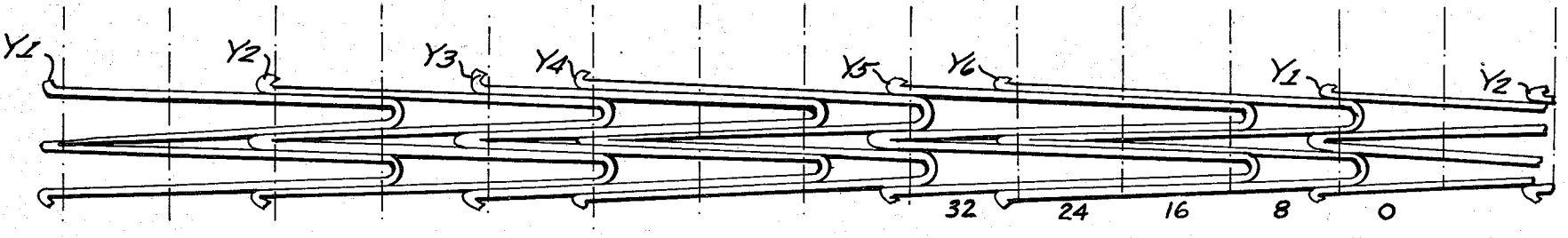
FIG. 4 is a diagrammatic showing of the pattern repeat in two courses of the ground yarn used in the fabric produced according to the present invention.
Figure 1:
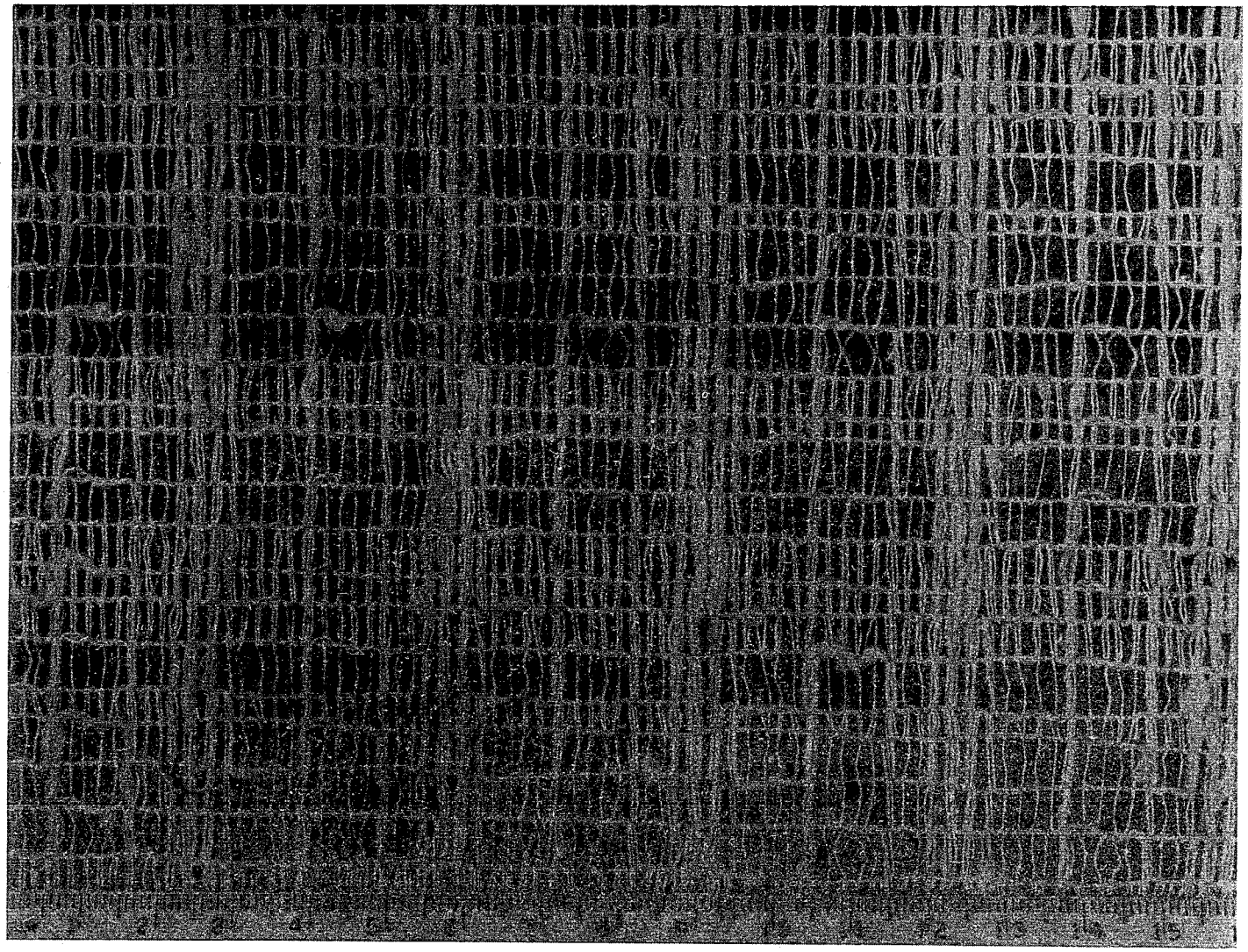

Turning now to the base fabric, shown in FIG. 7, attention is directed to FIGS. 4 and 5 and the preferred yarn patterns set forth therein. As is clear from a look at the fabric in FIG. 7, and as is conventional in warp knit fabrics, a plurality of yarns or a first group of yarns is formed into a plurality of chain stitches extending lengthwise along the fabric in the machine direction. While the formation of chain stitches by a warp knitting machine is conventional, bar 1 of a five or six bar raschel machine could be used to guide that first group of threads or yarns which are formed into the chains. A typical yarn is a 330 denier, 66 filament compacted or filament entangled, semi-dull, set textured yarn such as Celanese type D-282 FORTREL polyester. Such a yarn will usually be threaded within each thread guide in the bar and the threading could be such that in the selvage area the last end is doubled. This lapping formula, if converted to a 9 gauge formula would be 1-0/0-1 and in each instance represents a half-movement instead of a full movement of the guide bar. Typically, the shogging action for producing the stitch chains is 4-0/0-4//.

FIG. 4 sets forth the preferred pattern of the ground yarn which, in conjunction with the chain yarns and the yarns set forth in FIG. 5 produce the sheer fabric shown in FIG. 7. The repeating pattern of the ground or base yarn, as set forth in FIG. 4, is comprised of six yarns designated Y1-Y6. A typical yarn is a 10/1 spun rayon yarn and one repeat of threadup for the thread bar, for example, bar 5, is as follows: 1 in, 1 out, 1 in, 1 out, 2 in, 2 out, 2 in, 2 out. Another example of the threadup to produce a woven effect fabric is: 2 in, 2 out, etc. There may be other examples as well.

With reference again to FIG. 4, the vertical chain stitches are shown in phantom and the above threading arrangement produces the pattern shown in FIG. 4. Yarn Y1 begins at a given wale and is the "1 in" yarn referred to in the threading arrangement set forth above. There is no yarn introduced at the next wale and accordingly that corresponds to the "1 out" designation in the threading arrangement for bar 5. The next "1 in" reference is to yarn Y2 introduced in the next wale while the following wale which is skipped corresponds to the next "1 out" designation. Yarns Y3 and Y4 are introduced at the next two successive wales and these correspond to the first "2 in" designation. The next two wales are skipped which corresponds to the first "2 out" designation. This lapping formula, if converted to a 9 gauge formula would be 1-0/0-1 and in each instance represents a half-movement instead of a full movement of the guide bar. Yarns Y5 and yarns Y6 begin on the next two wales and together correspond to the second "2 in" requirement and the skipping of the next two successive wales before another Y1 yarn begins the next repeat corresponds to the last "2 out" designation. The bar controlling the feeding of this ground yarn is shogged in repeating pattern, which can be, for example, 0-0/32-32//.

The selvage portion for the ground yarn as controlled by bar 5, can be threaded for the right hand selvage as follows: 2 double, 2 out, 1 double, 1 single, 2 out, while the left hand selvage can be threaded 2 in, 2 out for three repeats.

The first yarn used to form the sheer or base fabric is shown in FIG. 5 and is the yarn most responsible for forming the weave look in the sheer fabric in FIG. 7. That yarn can be controlled by bar 4 of the knitting machine and the yarn may typically be a 3/25 open end spun rayon slubbed yarn. I prefer to employ several different shades, such as natural, cream and tan, as this provides a pleasant blended appearance. In threading the machine guide bar and these colors should be mixed to avoid producing streaks in the fabric such as follows: the cream yarn can be placed next to the natural followed by the tan with the next repeat starting with the natural and then following with the cream and tan and so on across the machine. It should be understood, however, that if several colors are used particular color repeats or yarn placement can be arranged in any desired fashion in order to achieve the desired look or effect wanted on the face of the fabric. This yarn is threaded in a 1 in, 1 out sequence so that every other tube of the bar is threaded. Here again, if more or less density is desired the threading arrangement could be change. The selvage area for this yarn can involve a bar threadup for the right selvage of "1 in" and "1 out" and "5 in" for the left selvage.

Figure 11:
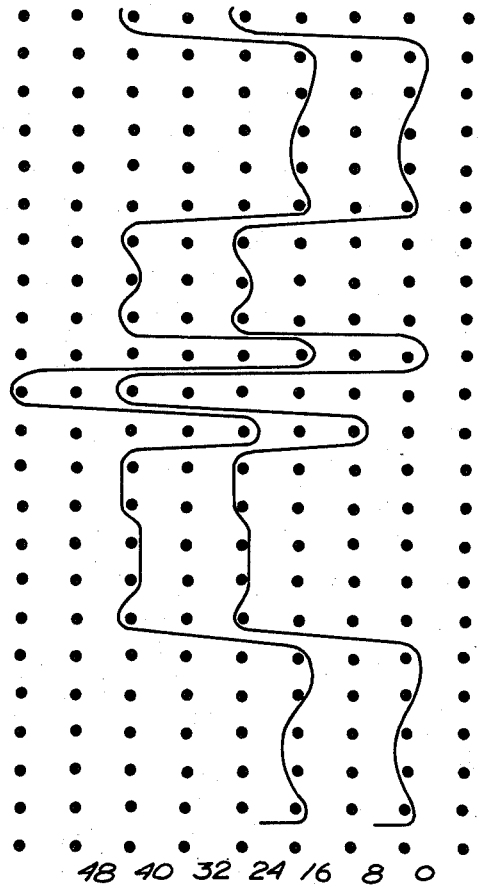
FIG. 11 is a needle diagram for the weave effect yarn shown in FIG. 5.

This yarn is controlled in its movement so that the end result appears as shown diagrammatically in FIG. 5, and more specifically in FIG. 11, which produces a stepped like appearance which will extend throughout the fabric. With reference to both FIGS. 5 and 11, the fabric repeat can begin, for example, at the letter A with the yarn being shogged in the following pattern from A to B over five courses: 0-0/8-8/8-8/0-0/0-0/. The yarn will then move from point B to point C, in one course and from C to D over another five course area. The shogging motion from C to D can be 32-32/24-24/24-24/32-32/32-32/. Moving from D to E the yarn will be moved back to an 8-8 position and in the next course, from point F to point G the yarns moved outwardly to a 48-48 position for one course beyond the boundary established by the vertical portion on the left side of the pattern extending from C to D and K to L. In the next course, extending from H to I, the yarn is moved back to a 0-0 position which establishes along with the run between A and B the right side boundary of the pattern shape. In the next course, extending from J to K, the yarn will move back to the 32-32 position and from K to L the shogging motion can be: 32-32/24-24/32-32//. Following the yarn's arrival at L the pattern repeat will begin again and the yarn is shogged back to its initial A position at 0-0. Thus, the overall shogging description for this repeating pattern can be identified as follows: 0-0/8-8/8-8/0-0/0-0/32-32/24-24/24-24/32-32/32-32/-8-8/48-48/0-0/32-32/24-24/32-32//.

The portion of this pattern which extends from F through G and H and back to I, as can be seen by the two yarns shown in FIG. 5, produces a strong horizontal stripe that extends across the fabric in a cross-machine direction. As indicated above, the boundaries of the pattern are established by yarn runs from A to B and I to J on one side and by C to D and K to L on the other side. Thus a box or step like pattern with many horizontal lines is produced by the portions extending from L to A, initially, and between B and C, D and E and K and J. Each of these horizontal areas produces a much more visual horizontal impression rather than a vertical impression so that the overall appearance of the fabric is more horizontal and thus woven with the portion extending from F to I forming distinct horizontal areas in the fabric.

By combining the chain stitch previously discussed together with the yarn pattern set forth in FIGS. 4 and 5 for the ground and weave effect yarns, respectively, it is possible to produce a woven-like sheer fabric that can be used directly as sheer drapery material. Thus, a warp knit machine has been used to produce what would appear to be a woven product. This of course presents many manufacturing advantages and this sheer fabric is used as a base to make complimentary heavier weight fabrics that also can be used as drapery material and especially drapery material that can be used in conjunction with the sheer material just described to form a double drape system compatible in styling and color. Further, the change over from manufacturing one to the other is extremely simple.

Figure 6:
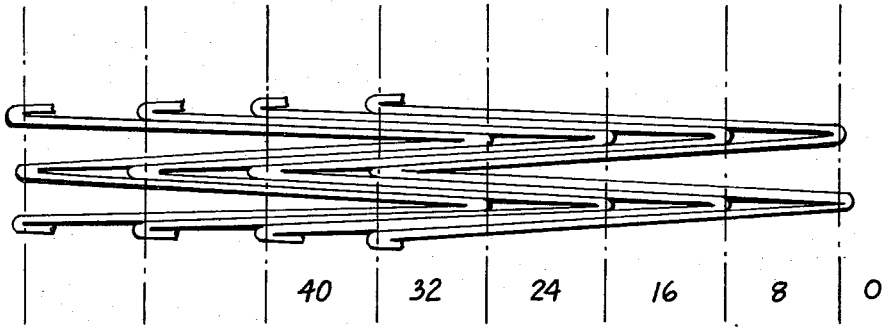
FIG. 6 is a diagrammatic view of two courses of the backing yarn which can be incorporated into the sheer fabric made according to the present invention.

The sheer or base fabric can be provided with a self-lining with yarns arranged in a pattern as shown in FIG. 6. The lining yarns can, for example, be controlled by bar 6 in the warp knitting machine with the yarns forming the backing material again being the 330/66/C semi-dull, set textured type D-282 FORTREL polyester yarn as was used to make the chain stitches. The bar will again have all of the thread guides threaded and the selvage can have the first two and last three yarns doubled in order to produce a stronger selvage. The knitting of this yarn should occur with as little as practical tension so that it can bloom to the fullest extent possible. The color may be white so that there will be no color repeats and the color will be solid throughout the bar. The shogging motion can be 40-40/0-0// so that the yarns will run back and forth over five wales. It should be pointed out that the self-lining yarns or threads are actually introduced on the technical front face of the knit fabric but in the fabrics finished form this becomes the rear face or surface of the fabric.

Figure 9:
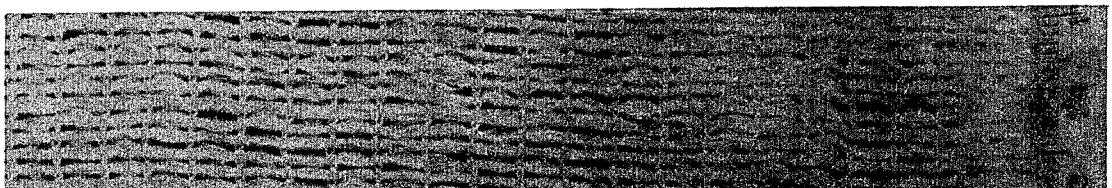
FIG. 9 is a photograph of the self-lining on the rear face of the fabric shown in FIG. 8.

The rear face of the fabric showing the effect of incorporating such self-lining yarns is shown in FIG. 9 and if a very highly blooming yarn is used the resulting effect is to completely fill out the rear portion of the fabric. It should be noted that the application of this self-lining to the sheer fabric can be accomplished by merely beginning the introduction of this additional yarn while making the sheer fabric so that no other changes in machine operation or control need be made.

In the past it has been known to use a non-woven material such as DELNET as a backing for such fabrics. DELNET is a non-wovern dry bonding fabric formed from high-density polyethylene or polypropylene which can be applied by heated calendar systems. It has been found, however, that when used in drapery materials the material not only adds a great deal of expense to the product but delamination is very frequent and it was not possible to hold consistent finished widths for knit drapery material, which is significant in the drapery area as consistent width goods is important to achieve uniform results when manufacturing drapes. Since such non-woven bonding materials are applied by heat, the material tended to shrink during bonding and accordingly dramatically changed the finished widths. Further, because such materials require some amount of melting and rehardening, the resulting knit fabric was not left with a pleasant or desirable soft hand but was rendered rather stiff. Also, the loft and bulkiness desirable in the fabric made according to the DELNET procedure was flattened during the passage of the fabric through the calendar rolls required to apply such non-woven bonding materials.

By incorporating the backing yarns as shown in FIGS. 6 and 9 a very full dense fabric is produced which has a very good soft hand. The fabric is less expensive to produce because the lining is introduced directly during fabric manufacture rather than an additional step. Subsequent processing of the fabric is reduced and does not flatten the loft and bulkiness of the fabric. Accordingly, the hand and yarn appearance remains soft and bulky so that the overall visual effect of the resulting fabric is very pleasing and desirable.

Figure 10:
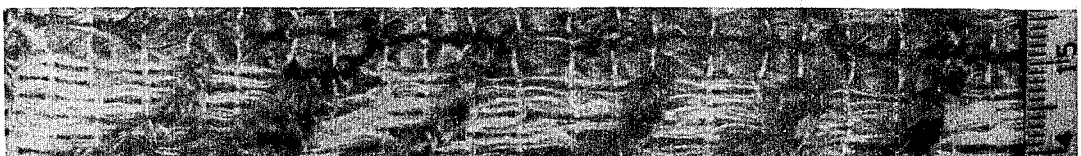
FIG. 10 is a photograph of the face of another exemplary fabric made according to the present invention.

Turning attention now to FIG. 10 an alternative exemplary fabric is shown which again incorporates the base or sheer fabric shown in FIG. 7, the backing yarns as shown in FIG. 9 and the top effect yarns. The top effect yarn now, however, is moved in a zig-zag pattern and to produce this pattern the shogging action of the bar guiding the top effect yarn can be as follows: 0-0/0-0/40-40/40-40/0-0/0-0/8-8/8-8/16-16/16-16/24--24/24-24/32-32/32-32/32-32/40-40/40-40/40-40/48-48-/48-48/40-40/40-40/40-40/32-32/32-32/32-32/24-24/2-4-24/26-26/26-26/8-8 8-8//.

Figure 8:
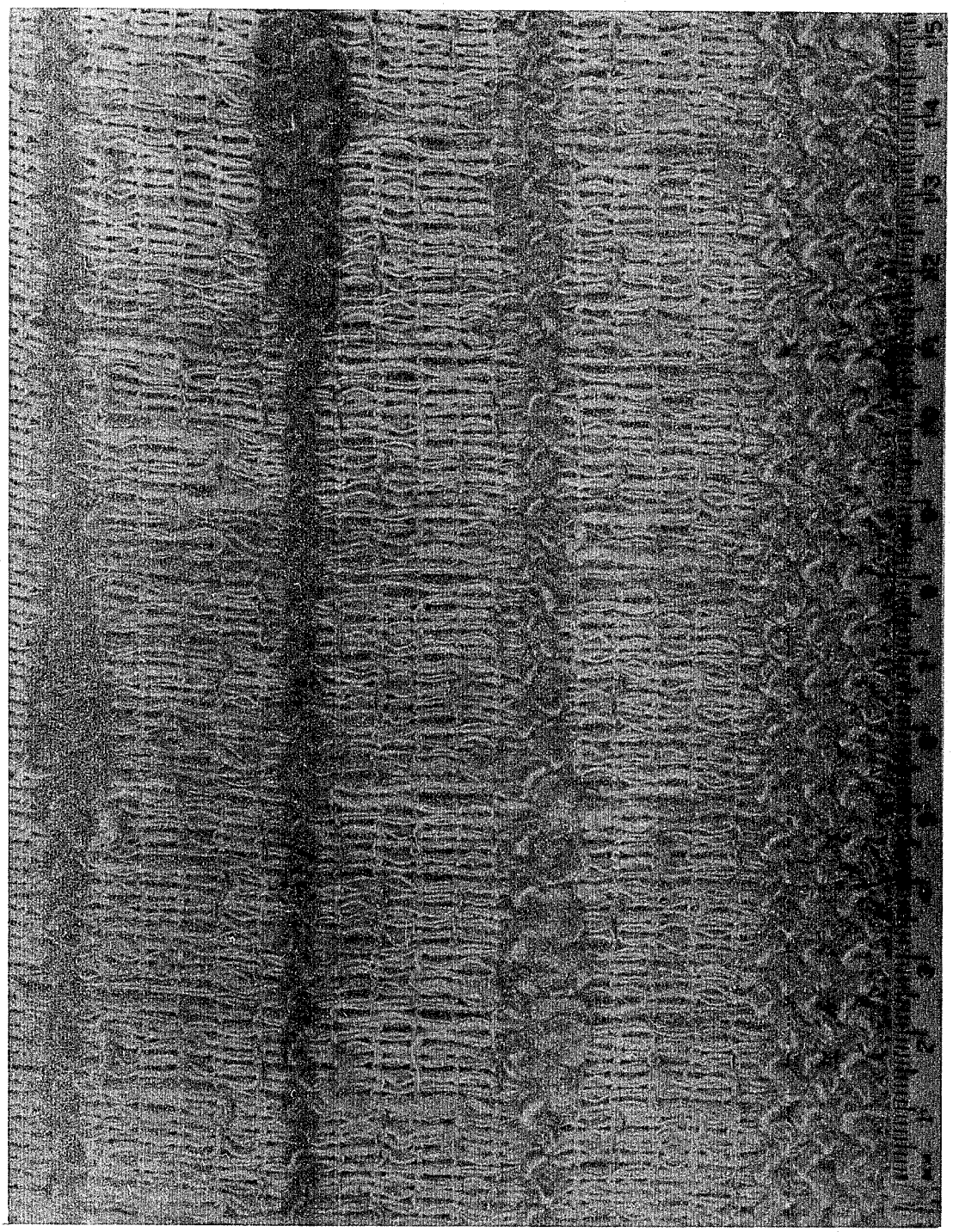
FIG. 8 is a photograph of the face of an exemplary full weight fabric made according to the present invention which includes both the base or ground fabric shown in FIG. 7 together with the backing yarn shown in FIG. 6 and the top efffect yarns shown in FIG. 1.

The present invention, therefore, discloses a plurality of fabrics beginning with the sheer fabric, shown in FIG. 7, and ending with the full weight fabrics shown in FIGS. 8 and 10. Standard finishing techniques can be used to finish the fabric and this includes the use of conventional resin treatments which are heat set at finishing temperatures ranging from 360° to 380° F.

Thus, the present invention produces a warp knit fabric that creates the visual appearance of being woven and allows the use of regular yarns. Also, many colors can be used and when knit according to the instructions discussed hereinbefore produce a fabric that does not include vertical stripes but rather is comprised of a balance construction with each stitch chain supporting about the same amount or quantity of yarn.

Particularly important according to the present invention is the use of the tensioning apparatus controlled as described above, wherein the top effect yarns can be supplied to produce novel effects such as the forming of that yarn into a ratine-like slubbed yarn with the tensioning apparatus allowing normal tension with a quick release from normal to zero tensions and vice versa. Other forms of apparatus can also be employed to control the tensioning effect, such as a magnetic brake, an electronic activating device, a variable speed motor, variable speed rollers, a hydraulic system, a pneumatic system, or equivalent devices.

It should also be stressed that this tensioning apparatus can be used to apply the ratine-like slubbed yarn effect to various fabrics where such an individual yarn styling effect is desired, for example on other warp knit and stitch bonded fabrics, for example, those of the Malimo and Arachne type. Hence, the ratine-like slub yarn effect is not limited to use with the base fabric constructions specifically disclosed herein.

I have also discovered that it is possible to create a boucle like fabric effect by controlling individual ends of finer count yarns with the tensioning device described herein, to make the base fabric, or to make a top effect design on a plain fabric base. The individual yarn ends can also be controlled with this tensioning device to create patches of boucle effect, interspersed with plain fabric areas.

While the invention has been described in connection with what is presently considered to be the most practical and preferred embodiment, it is to be understood that the invention is not to be limited to the disclosed embodiments but on the contrary, is intended to cover various modifications and equivalent arrangements included within the spirit and scope of the appended claims, which scope is to be accorded the broadest interpretation so as to encompass all such modifications and equivalent structures.

What I claim is:

1. A warp knit fabric comprised of a plurality of chain stitches extending in the warp-wise direction of the fabric, a first plurality of in-laid ground effect yarns extending in a series of repeating patterns primarily in the course-wise direction and a second plurality of in-laid yarns inserted at and along predetermined wales so that each of said second yarns extend primarily horizontally in a repeating stepped pattern formed between two wale-wise outer boundaries with said repeating stepped pattern extending throughout the fabric which is thereby given the appearance of being woven, said repeating stepped pattern having at least first, second and last warp-wise extending steps each of which extend over at least three courses, said first step establishing at least part of one of said two outer boundaries, said second and last steps being positioned adjacent the middle of said stepped pattern, with at least one of said second or last steps being spaced four wales from said first step in a direction toward the other of said two outer boundaries, and at least one weft-wise extending traverse, positioned intermediate said first and last steps, for establishing the other of said two outer boundaries, said other boundary being spaced outwardly at least two wales from the said second or last step which is positioned farthest from said first step toward said other boundary.

2. A fabric as in claim 1 wherein said second in-laid yarns are introduced at every other wale.

3. A fabric as in claim 1 wherein the second plurality of in-laid yarns comprise slubbed yarns.

4. A fabric as in claim 1 wherein the first plurality of in-laid ground effect yarns have been laid onto the fabric in a one in, one out repeated pattern, followed by a two in, two out repeated pattern.

5. A fabric as in claim 4 wherein each yarn extends in the course-wise direction across about four wales.

6. A fabric as in claim 1 further including a third plurality of in-laid self-lining effect yarns laid onto that surface of the fabric forming the rear face of the finished fabric.

7. A fabric as in claim 6 wherein the third plurality of in-laid self-lining effect yarns are introduced at every wale.

8. A fabric as in claim 6 wherein each of the third plurality of in-laid self-lining effect yarns extends across about five wales.

9. A fabric as in claim 6 wherein said in-laid self-lining effect yarn is a textured yarn.

10. A fabric as in claim 6 wherein said in-laid self-lining effect yarn is a 330/66/C semi-dull set textured polyester.

11. A process for producing a sheer warp knit fabric comprising the steps of forming a first group of wale-wise extending ends into a plurality of stitch chains, introducing a second group of a plurality of ends by laying them into and securing them in a wale-wise manner across the stitch chains on the front side of the fabric at predetermined locations and causing each of the ends in said second group to traverse across a plurality of wales so as to tie the stitch chains together and introducing a third group of a plurality of ends by laying them into and securing them in the stitch chains on the front side of the fabric at preselected positions and forming each of the ends in said third group into a repeating stepped pattern that extends throughout the fabric whereby the step of forming the ends in said third group into a repeating pattern further includes forming two warp-wise extending pattern boundaries, forming at least three warp-wise extending steps within said repeating pattern with at least one of said steps forming a portion of the boundary on one side of the pattern and forming at least a portion of the boundary on the other side of the pattern by at least one weft-wise extending traverse, said at least one weftwise traverse being at least four valves wide.

12. A process as in claim 11 wherein the pattern of said third group of ends extends across six wales in the course-wise direction and sixteen courses in the wale-wise direction.

13. A process as in claim 11 wherein the repeating pattern extending warp-wise along the fabric includes a substantially straight boundary on each side and said three warp-wise steps in each repeat extend across at least three courses.

14. A process as in claim 11 including the further step of moving the second group of ends during knitting in a 0-0/32-32// pattern.

15. A process as in claim 12 including the further step of moving the third group of ends during knitting in a 0-0/8-8/8-8/0-0/0-0/32-32/24-24/24-24/32-32/32-32/-8-8/48-48/0-0/32-32/24-24/32-32// pattern.

16. A process as in claims 11 or 14 including the further step of threading the third group of a plurality of ends in a repeating one in, one out pattern.

17. A process as in claim 11 including the further step of threading the second group of a plurality of ends in a repeating one in, one out, one in, one out, two in, two out, two in, two out pattern.

18. A process as in claim 11 including the further step of introducing a plurality of self-lining backing yarns by laying them on the rear face of the fabric at preselected wales and securing them in the stitch chains so that a lining is formed on the rear side of the fabric.

19. A process as in claim 18 wherein the self-lining yarn is introduced at each wale.

20. A process as in claims 11 or 18 including the further step of introducing a plurality of top effect yarns by laying them in on the front face of the fabric at preselected locations and securing the top effect yarn on the fabric.

21. A process as in claim 20 wherein the step of introducing the top effect yarn includes the steps of tensioning and untensioning the feeding of the yarn in a predetermined manner so as to produce ratine or slub like effects in said top effect yarn.

22. A fabric as in claim 1 wherein said plurality of ground effect yarns are laid into said fabric in a repeating pattern extending across at least ten wales with each repeat being formed from six yarns, whereby said six yarns are respectfully introduced at six predetermined wales within said ten wale repeating pattern and caused to traverse weft-wise across at least three wales.

23. A warp knit fabric comprised of a plurality of chain stitches extending in the warp-wise direction of the fabric, a first plurality of in-laid ground effect yarns extending in a series of repeating patterns primarily in the course-wise direction and a second plurality of in-laid yarns inserted at and along predetermined wales so that they extend primarily horizontally in a repeating stepped pattern throughout the fabric which is given the appearance of being woven as a result of the horizontal pattern of the second in-laid yarn, wherein the pattern for said second in-laid yarn runs in the wale-wise direction adjacent a first wale for five courses, then runs across four wales in one course-wise direction, followed by a run adjacent that fourth wale in the machine direction for five courses, returning in the opposite course-wise direction across three wales to a second wale, then extending back again in said one course-wise direction across five wales in the next course followed by another return across six wales in the opposite course-wise direction in the next course then extending back again in said one course-wise direction across four wales in the next course, followed by a run in the wale-wise direction adjacent the fourth wale for three courses and then a return across four wales to a pattern repeat starting position at said first wale in the next course.

* * * * *